US005682982A

United States Patent [19]

Stonehouse

[11] Patent Number: 5,682,982

[45] Date of Patent: Nov. 4, 1997

[54] BOTTLE CARRIER

[75] Inventor: Donald Bruce Stonehouse, Kenosha, Wis.

[73] Assignee: Field Container Company, L.P., Elk Grove Village, Ill.

[21] Appl. No.: 607,324

[22] Filed: Feb. 26, 1996

[51] Int. Cl.[6] ..... B65D 71/40

[52] U.S. Cl. ..... 206/142; 53/452; 206/151; 206/158; 206/197

[58] Field of Search ..... 206/145–149, 206/151, 153, 158, 161, 168, 169, 192, 197, 200, 427, 432, 142; 53/452

[56] References Cited

U.S. PATENT DOCUMENTS

| | | | |
|---|---|---|---|
| 2,397,716 | 4/1946 | Wendler | 206/148 |
| 2,737,326 | 3/1956 | Toensmeier | 224/45 |
| 2,950,041 | 8/1960 | Stone | 206/147 |
| 3,073,644 | 1/1963 | Baker et al. | 294/87.2 |
| 3,156,358 | 11/1964 | Randrup | 206/65 |
| 3,784,246 | 1/1974 | Klygis | 294/87.2 |
| 3,860,281 | 1/1975 | Wood | 294/87.2 |
| 3,897,873 | 8/1975 | Graser | 206/153 |
| 4,372,599 | 2/1983 | Kiedaisch et al. | 294/87.2 |
| 4,621,734 | 11/1986 | Heijnen et al. | 206/427 |
| 4,736,977 | 4/1988 | Killy | 294/87.2 |
| 5,267,644 | 12/1993 | Tsao | 206/151 |
| 5,344,006 | 9/1994 | Mazzeo | 206/153 |

FOREIGN PATENT DOCUMENTS

| | | | |
|---|---|---|---|
| 1418015 | 10/1965 | France | 206/147 |
| 2271097 | 4/1994 | United Kingdom | 206/151 |

*Primary Examiner*—Jimmy G. Foster
*Attorney, Agent, or Firm*—Marshall, O'Toole, Gerstein, Murray & Borun

[57] ABSTRACT

A blank for carrying bottles with an engaging edge has a center panel, a pair of securing panels, a pair of handle panels, an exterior grip support panel and an interior grip support panel. The center panel has a plurality of apertures and access tabs formed therein, and each aperture has an access tab associated therewith. The securing panels have apertures formed therein to match the number of apertures in the center panel. The securing panels also have individual flaps formed therein, and each aperture of the securing panels is associated with an individual flap. When the blank is folded and formed into a carrier, the apertures and access tabs of the center panel and the apertures and individual flaps of the securing panel create a corresponding number of bottle receiving collars. Consequently, when bottles are placed into the carrier, each bottle receiving collar engages the engaging edge of each bottle and supports each bottle during transport.

25 Claims, 7 Drawing Sheets

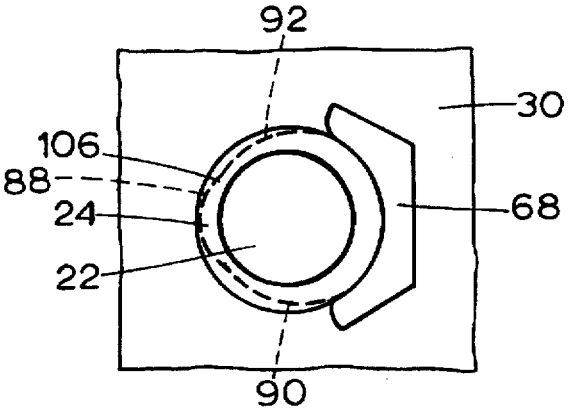
FIG. 14
FIG. 15
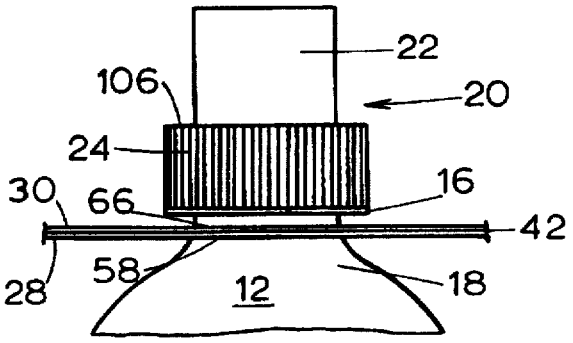
FIG. 16
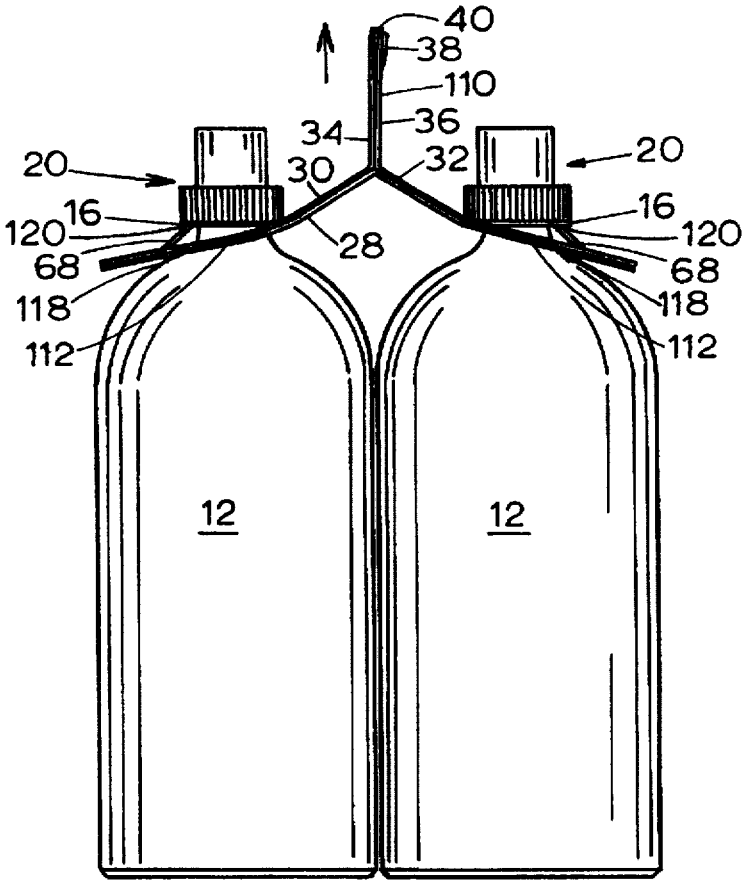

BOTTLE CARRIER

TECHNICAL FIELD

The present invention relates generally to bottle carriers, and more particularly to paperboard carriers for holding bottles having an engaging lip or edge.

BACKGROUND ART

Prior paperboard bottle carriers have suffered from a number of shortcomings. Many carriers were too weak structurally and could not support the weight of the bottles they were carrying. To address this problem, a number of carriers were developed that were stronger structurally, but were very complex to assemble--especially for a manufacturing facility using automated machines.

Many of these early paperboard bottle carriers utilized a series of radial cuts or sunburst apertures in the paperboard to hold the bottles. The radial cut-type securing devices were often unreliable because bottles can be too heavy to be supported by the radially cut paperboard and the bottles would fall through the carrier. This was especially true when the carrier had been stored for a long time. In storage, the shoulder of the bottle would push upward against the radial cuts when the carriers were stacked. Consequently, the paperboard near the radial cuts would develop a permanent upward bend in this position. As a result, when the carrier was lifted after storage, the bottles would fall out because the bent radially cut paperboard no longer provided sufficient support.

Due to the shortcomings in the prior bottle carriers, a need has developed for a paperboard bottle carrier that is inexpensive and easy for automated equipment to assemble, strong enough to support a number of bottles and less susceptible to developing a disabling bend in storage.

SUMMARY OF THE INVENTION

There is provided in accordance with one aspect of the present invention a blank for forming a carrier for carrying a plurality of bottles, where each bottle has an engaging edge with a diameter. The blank has a plurality of panels connected to each other. A center panel has a plurality apertures formed therein and the center panel also has a pair of opposing edges. A pair of securing panels is connected to the opposing edges of the center panel. A plurality of apertures and a plurality of individual flaps are formed in the securing panels. Each aperture of the securing panel is associated with an individual flap, such that in a bottle carrying position, the association of the aperture with the individual flap defines a diameter less than the diameter of the engaging edge of the bottle. A pair of handle panels is connected to the pair of securing panels.

The center panel may include a plurality of access tabs, where each aperture of the center panel is associated with an access tab. Each access tab may include an arcuate portion on an end of the tab that extends into the associated aperture of the center panel. Furthermore, the access tab may be disposed such that when the securing panels are folded over the center panel, a plurality of bottle receiving collars are formed, with each collar having an access tab and an individual flap on opposite sides of the bottle receiving collar.

Each individual flap may include a curved lip and a hinge, and the individual flap may be generally U-shaped. The hinge of the individual flap may be parallel to the pair of opposing edges of the center panel, and the hinge may be disposed between one of the opposing edges of the center panel and the curved lip of the individual flap.

Each aperture of the securing panel may be defined by the curved lip of the individual flap, an access lip opposite the curved lip and a pair of main support lips disposed between the curved lip and the access lip.

Each handle panel may have a handle opening, and at least one of the handle openings may have an edge. The blank may include an exterior grip support panel connected to the edge of the at least one handle opening. The blank may include an interior grip support panel connected to an outer edge of one of the handle panels.

In accordance with another embodiment of the present invention, a carrier carries a plurality of bottles, where each bottle has an engaging edge with a diameter. A bottle carrying portion includes a top panel connected to a bottom panel. A plurality of apertures and a plurality of individual flaps are formed in the top panel and each aperture is associated with an individual flap. A plurality of apertures are formed in the bottom panel. The apertures and individual flaps of the top panel and the apertures of the bottom panel form a plurality of bottle receiving collars. A handle is attached to and extends from the bottle carrying portion.

Another aspect of the present invention is a method for forming a carrier for carrying a plurality of bottles, where each bottle has an engaging edge with a diameter. The method includes creating a blank having a center panel with a plurality of apertures formed therein, and a pair of securing panels having formed therein a plurality of apertures and a plurality of individual flaps. The method further includes placing the bottles into the apertures of the center panel; pushing the center panel downward until the center panel is below the engaging edge of the bottle; placing the bottles into the apertures of the center panels; pushing the securing panels downward until the securing panels and the individual flaps are beneath the engaging edge of each bottle; and adhering the securing panels to the center panel.

Another embodiment of the present invention is a blank for forming a carrier for carrying a plurality of bottles, where each bottle has an engaging edge with a diameter. The blank has a plurality of panels connected to each other. A center panel has formed therein a plurality of apertures and a plurality of access tabs. Each aperture of the center panel is associated with an access tab. The center panel has a pair of opposing edges and a pair of securing panels is connected to the opposing edges of the center panel. A plurality of apertures and a plurality of individual flaps are formed in the securing panels. Each aperture of the securing panel is associated with an individual flap, such that in a bottle carrying position, the association of the aperture with the individual flap defines a diameter less than the diameter of the engaging edge of the bottle. The individual flaps are disposed such that when the securing panels are folded over the center panel, a plurality of bottle receiving collars are formed, with each collar having an access tab and an individual flap on opposite sides of the bottle receiving collar.

Other features and advantages are inherent in the blank and the carrier of the present invention or will become apparent to those skilled in the art from the following detailed description in conjunction with the accompanying diagrammatic drawings.

BRIEF DESCRIPTUON OF THE DRAWINGS

FIG. 10;

FIG. 14 is a top plan view of the securing panel of FIG. 12 beneath the bottle cap;

FIG. 15 is a side elevational view of FIG. 14; and

FIG. 16 is a side elevational view of a formed bottle carrier lifted upward by its handle.

DESCRIPTION OF THE PREFERRED EMBODIMENT

Figure 1:
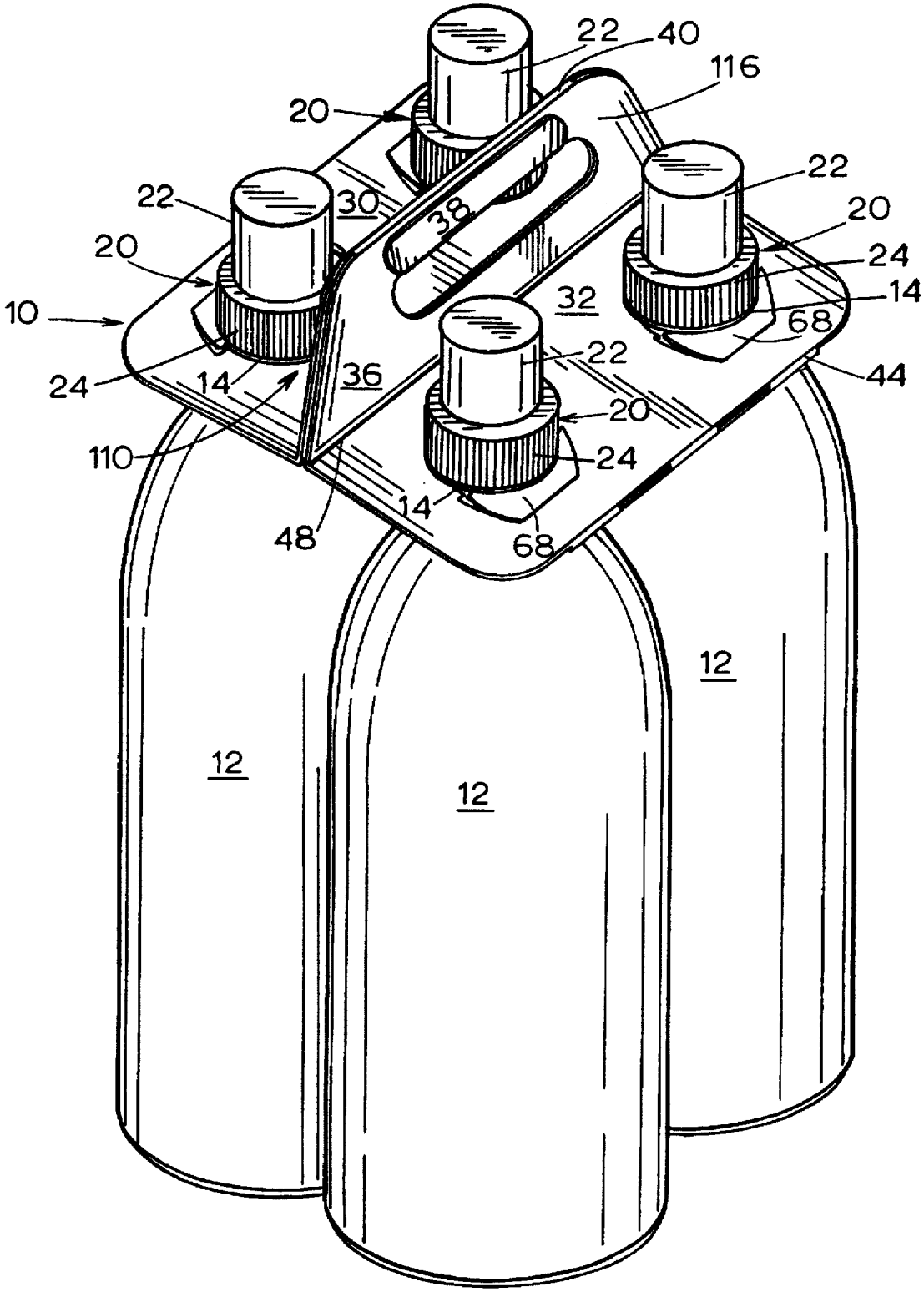
FIG. 1 is a perspective view of a formed bottle carrier of the present invention.

FIG. 1 illustrates a bottle carrier 10 in a formed condition holding four bottles 12. Even though four bottles are illustrated, any number of bottles could be used. The bottles 12 each have some form of an engaging edge 14. FIGS. 1 and 5–16 illustrate two different types of engaging edges 14; however, bottles with other types of engaging edges could be used with the carrier 10. The first type of engaging edge is an annular lip 16 (FIG. 5) formed integrally with a neck 18 of the bottle 12. The annular lip 16 is greater in diameter than the neck 18. The second type of engaging edge is a cap 20 of the bottle 12. The cap 20 may include a top portion 22 and a bottom portion 24 that may be wider than the top portion 22.

Figure 2:
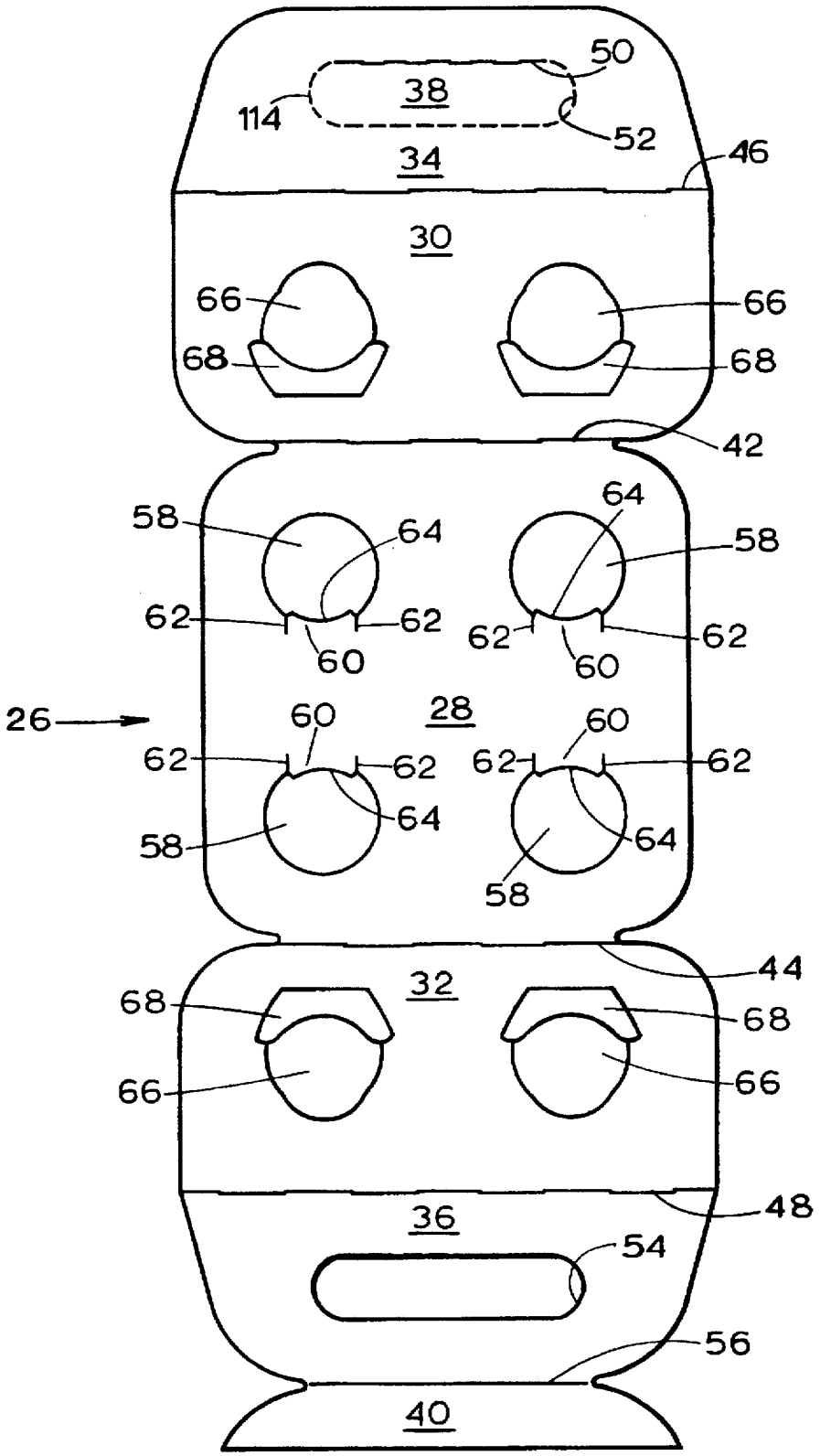
FIG. 2 is a top plan view of a paperboard blank for forming a bottle carrier in accordance with the present invention.
Figure 3:
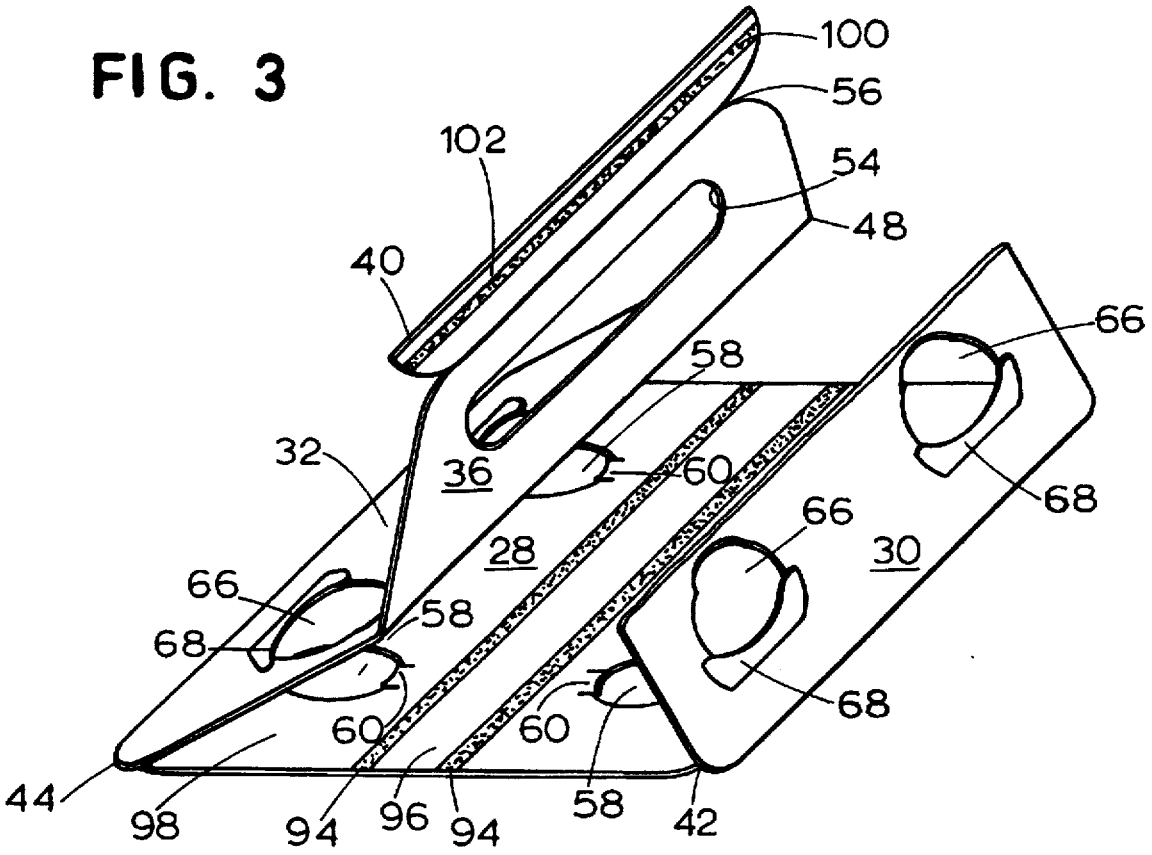
FIG. 3 is a perspective view of the blank of FIG. 2 partially formed into a bottle carrier with adhesive applied.

The bottle carrier 10 may be formed from a blank 26, shown in FIG. 2. The blank 26 may be made from a paperboard material 0.56 mm thick or from any other material conventionally used in carton formation. The blank 26 includes a center panel 28, a pair of securing panels 30 and 32, a pair of handle panels 34 and 36, an exterior grip support panel 38 and an interior grip support panel 40. The center panel 28 is hingedly connected to the securing panels 30, 32 by fold lines 42, 44, respectively. The fold lines are preferably defined by pressing, scoring or some other line-forming process. The securing panels 30, 32 are hingedly connected to the handle panels 34, 36 by fold lines 46, 48, respectively. The exterior grip support panel 38 is hingedly connected to the handle panel 34 by a fold line 50 and is positioned in a handle opening 52, formed in the handle panel 34. The handle panel 36 has a similar handle opening 54 formed therein. The interior grip support panel 40 is hingedly connected to the handle panel 36 by a fold line 56. By folding the blank 26 along the previously described fold lines, as illustrated in FIG. 3, the bottle carrier 10 is formed.

Referring again to FIG. 2, four apertures 58 are formed in the center panel 28. Although four apertures 58 are shown in the embodiment of FIG. 2, any number of apertures could be used. Also formed in the center panel 28 are four access tabs 60, one for each aperture 58 of the center panel 28. Each access tab 60 is defined by a pair of short cut lines 62 through the center panel 28 and an arcuate portion 64 that extends into the aperture 58 of the center panel 28.

Figure 2A:
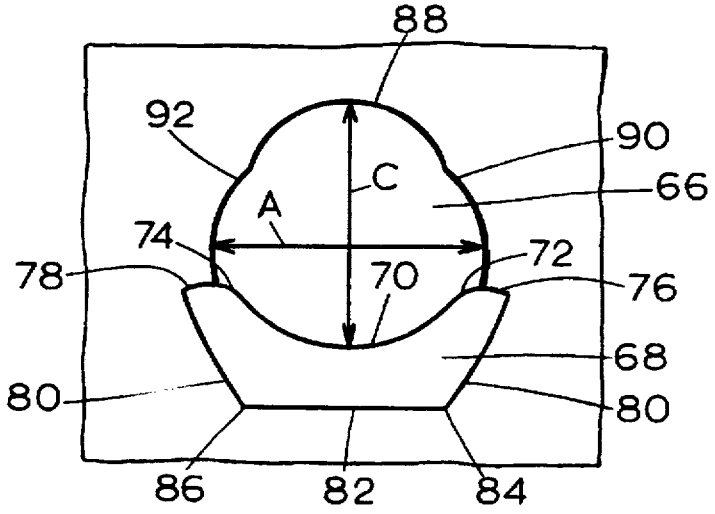
FIG. 2A is a fragmentary enlarged view of a portion of the blank of FIG. 2.

The securing panels 30, 32 have apertures 66 formed therein. The total number of apertures 66 in the securing panels 30, 32 is equal to the total number of apertures 58 formed in the center panel 28. Four, generally U-shaped, flaps 68 are also formed in the securing panels 30, 32 so that a single flap 68 is associated with each aperture 66. FIG. 2A illustrates the aperture 66 and the flap 68 in greater detail. Each flap 68 includes a curved lip 70 having opposite ends 72, 74, a pair of curved edges 76, 78, a pair of sides 80 and a hinge 82 having opposite ends 84, 86. The hinge 82 of each flap 68 may be defined by a score in the paperboard material and is disposed parallel to fold lines 42 and 44 (FIG. 2). The sides 80 of each flap 68 may be defined by cuts through the paperboard material. The sides 80 start on opposite ends 84, 86 of the hinge 82 and extend outward, in the direction of the aperture 66, until the sides 80 curve to form the curved edges 76, 78. The curved edges 76, 78 connect to opposite ends 72, 74 of the curved lip 70.

Figure 5:
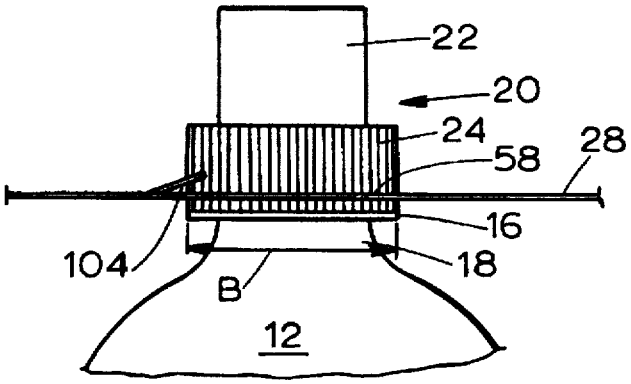
FIG. 5 is a side elevational view of FIG. 4.

Each aperture 66 of the securing panels 30, 32 is defined by three portions: an access lip 88, a pair of main support lips 90, 92 and the curved lip 70 of the flap 68. The main support lips 90, 92 define a diameter A of the aperture 66. The diameter A is approximately the same as a diameter B of the annular lip 16 of each bottle 12 (FIG. 5). The curved lip 70 has a larger radius of curvature than the main support lips 90, 92. The access lip 88 has a smaller radius of curvature than the main support lips 90, 92. The curved lip 70 and the access lip 88 define a diameter C across the aperture 66 which is less than the diameter B of the annular lip 16 of each bottle 12 (FIG. 5).

FIG. 3 illustrates the steps for forming the bottle carrier 10 without the bottles 12. In practice, the bottle carrier 10 would be formed around the bottles 12; and FIG. 3 is meant only to clearly illustrate the relative positions of the components of the bottle carrier 10. To form the bottle carrier 10 without the bottles 12, a pair of layers of adhesive 94 are applied along the length of a middle 96 of a top surface 98 of the center panel 28 and a single layer of adhesive 100 is applied along a top surface 102 of the interior grip support panel 40. Next, the securing panels 30, 32 are folded along the fold lines 42, 44; the handle panels 34, 36 (handle panel 34 has been omitted from FIG. 3 for clarity) are folded along the fold lines 46, 48 and the interior grip support panel 40 is folded along the fold line 56 until the interior grip support panel 40 and the layer of adhesive 100 are brought into contact with the handle panel 36, adhering the interior grip support panel 40 to the handle panel 36. The securing panels 30, 32, are then folded inward toward the middle 96 of the center panel 28 until the securing panels 30, 32 contact the pair of layers of adhesive 94 and the handle panels 34, 36 abut one another. The blank 26, as illustrated, is constructed from a single piece of paperboard. However, the center panel 28, the securing panels 30, 32 and the handle panels 34, 36 could all be separate pieces or any combination of separate pieces and attached to one another using additional adhesive.

Figure 4:
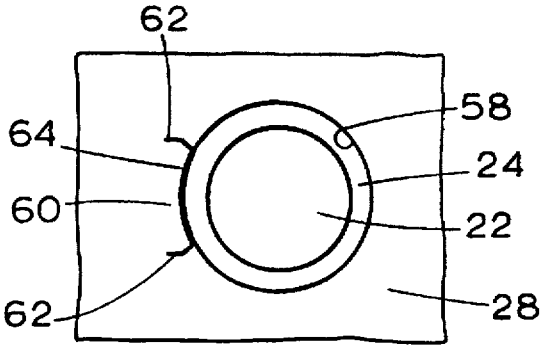
FIG. 4 is a fragmentary top plan view of the center panel of the blank of FIG. 2 engaged with a cap of a bottle.
Figure 6:
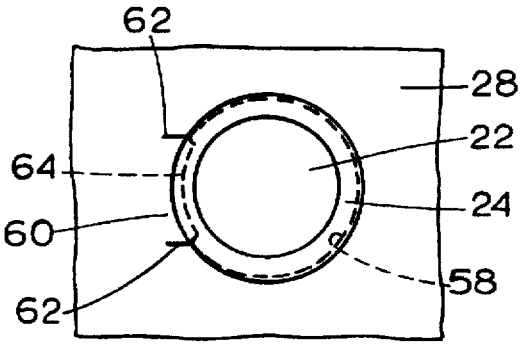
FIG. 6 is a top plan view of the center panel of FIG. 4 beneath the bottom of the bottle cap.
Figure 7:
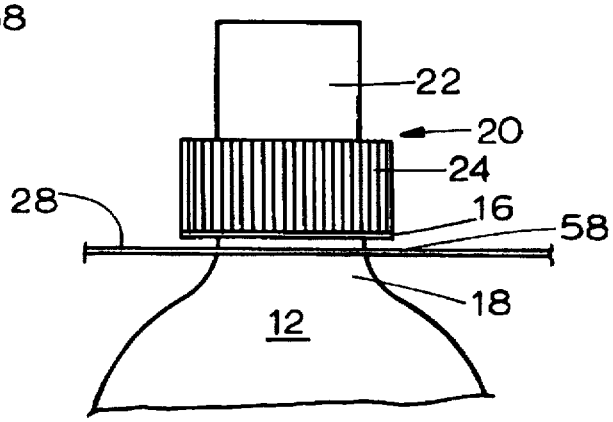
FIG. 7 is a side elevational view of FIG. 6.

FIGS. 4–15 illustrate the steps for forming the bottle carrier 10 with the bottles 12. First, the center panel 28 is pressed down over the bottom portion 24 of the cap 20 and the annular lip 16 of the bottles 12 (FIGS. 4–7). The aperture 58 is approximately the same diameter as the diameter of the bottom portion 24 of the cap 20 and the annular lip 16 of the bottle 12. Therefore, lining up and pressing the aperture 58 over the bottom portion 24 and the annular lip 16 would require a machine (not shown) of great precision to perfectly form the bottle carrier 10 every time in mass operation. The access tab 60, however, facilitates that process by providing flexibility to the panel. As the bottle 12 is pushed through the aperture 58, the bottom portion 24 of the cap 20 comes into contact with the access tab 60 and pushes the access tab 60 upward from the center panel 28 (FIG. 4–5). An opening 104 is created between the pair of short cut lines 62 to allow additional space for the cap 20 to pass through the aperture 58. As illustrated in FIGS. 6 and 7, once the center panel 28 is pushed below the annular lip 16, the access tab 60 springs back into place. In this position, the access tab 60 extends below the annular lip 16 of the bottle 12 and helps secure the center panel 28 below the annular lip 16.

Figure 8:
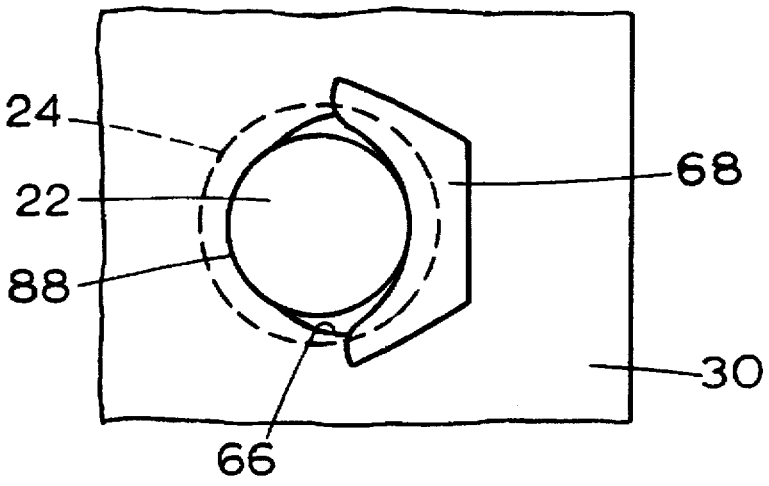
FIG. 8 is a fragmentary top plan view of a securing panel of the blank of FIG. 2 being folded over the top of the bottle cap.
Figure 9:
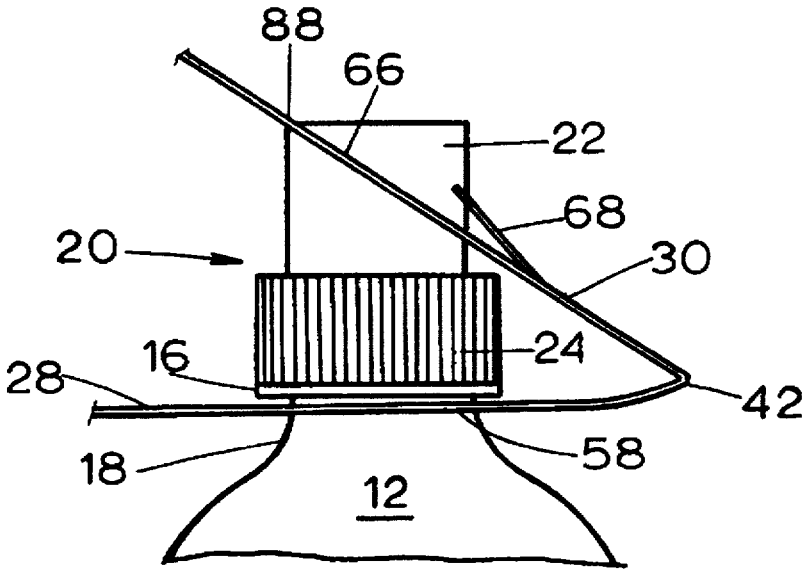
FIG. 9 is a side elevational view of FIG. 8.
Figure 10:
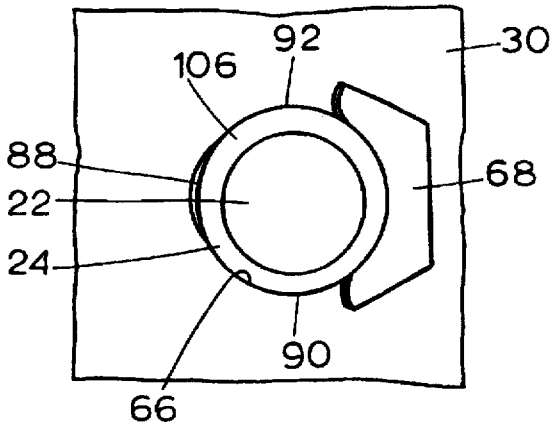
FIG. 10 is a top plan view of the securing panel of FIG. 8 pushed further under the bottle cap.
Figure 11:
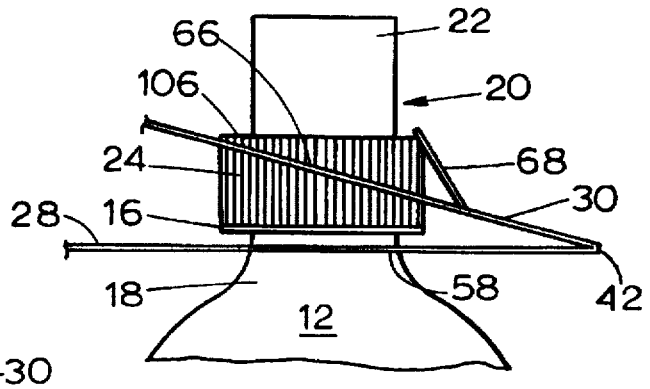
FIG. 11 is a side elevational view of FIG.
Figure 12:
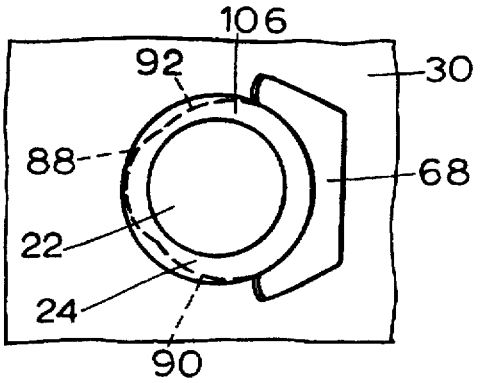
FIG. 12 is a top plan view of the securing panel of FIG. 10 pushed further under the bottle cap.
Figure 13:
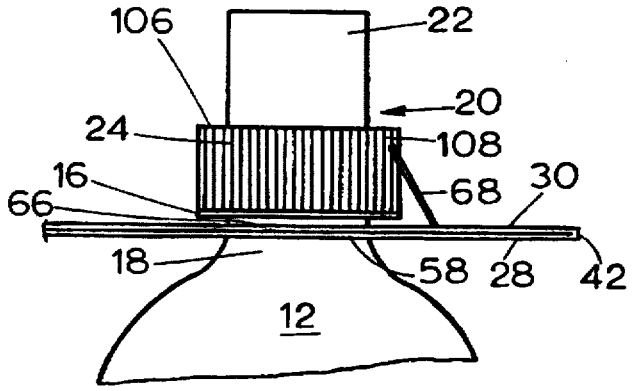
FIG. 13 is a side elevational view of FIG.

The next step is folding the securing panels 30, 32 inward toward the caps 20 along the fold lines 42, 44 and folding the handle panels 34, 36 along the fold lines 46, 48 (FIG. 3). As shown in FIGS. 8–15, the securing panels 30, 32 are pressed down over the bottom portion 24 of the cap 20, in a manner similar to the center panel 28 being pressed down over the caps 20. The access lip 88 of the aperture 66 allows each securing panel 30, 32 to fit over the top portion 22 of the cap 20, as shown in FIGS. 8 and 9. Next, as illustrated in FIGS. 10 and 11, each securing panel 30, 32 continues to be pushed downward over the bottom portion 24 of the cap 20. As each securing panel 30, 32 comes in contact with the bottom portion 24, the main support lips 90, 92 develop a snug fit with the bottom portion 24 of the cap 20. Simultaneously, the flap 68 comes in contact with a top surface 106 of the bottom portion 24 of the cap 20 and is pushed upward. Each securing panel 30, 32 continues on a downward path until each securing panel 30, 32 is pushed below the annular lip 16 of the bottle 12, and brought in contact with the layer of adhesive 94 on the center panel 28 (FIG. 3). During this phase, the flap 68 remains in an upward position and runs along an outside 108 of the bottom portion 24 of the cap 20, as illustrated in FIGS. 12 and 13. Finally, as illustrated in FIGS. 14 and 15, the flap 68 is pulled underneath the annular lip 16 of the bottle 12 by the continued downward movement of each securing panel 30, 32.

Lastly, a handle 110 is formed. FIGS. 1, 3 and 16 illustrate the formation of the handle 110. At this point, the handle panels 34, 36 have already been folded, and as a result of the previously described steps, the handle panels 34, 36 now abut each other and extend outward from the center panel 28. The handle panels 34, 36, when combined in the manner described, define the handle 110.

Once the carrier 10 is assembled, the flap 68 and the access lip 88 define the diameter C (FIG. 2A). The diameter C is less than the diameter B of the engaging edge 14 of the bottle 12 and allows the carrier 10 to support the bottles 12 in a bottle carrying position. Additionally, when the securing panels 30, 32 are folded over the center panel 28, the apertures 58 and the access tabs 60 of the center panel 28 and the apertures 66 and the flaps 68 of the securing panels 30, 32 create four bottle receiving collars 112 (FIG. 16). The access tab 60 and the flap 68 associated with each collar 112 are disposed on opposite sides of the collar 112.

When the bottle carrier 10 is picked up for the first time, the exterior grip support panel 38 will be pushed inward causing the exterior grip support panel 38 to separate from a perforated edge 114 (FIG. 2) of the handle opening 52 and fold along the fold line 50. As the exterior grip support panel 38 continues to be folded inward along the fold line 50, the exterior grip support panel 38 makes contact with an outer surface 116 (FIG. 1) of the handle panel 36. In the configuration described, as illustrated in FIG. 1, the exterior grip support panel 38 provides additional support to the handle 110 of the bottle carrier 10.

When the bottle carrier 10 is lifted by the handle 110, as shown by the arrow in FIG. 16, the flap 68 is pulled inward towards the handle 110 and pushed upward by a shoulder 118 of the bottle 12. The flap 68 is pushed upward until the curved lip 70 and the curved edges 76, 78 (FIG. 2A) of the flap 68 engage a bottom surface 120 of the engaging edge 14 of the bottle 12. The size and shape of the flap 68, combined with the support the center panel 28 provides underneath the flap 68, keep the bottle 12 secure during transport and prevent the bottle 12 from falling out of the carrier 10.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A blank for forming a carrier for carrying a plurality of bottles, wherein each bottle has an engaging edge with a diameter, comprising:

a center panel having a plurality of apertures formed therein;

a pair of opposing edges on the center panel;

a pair of securing panels connected to the opposing edges of the center panel;

a plurality of apertures and a plurality of flaps formed in the securing panels, wherein each aperture of the securing panel has only one flap associated therewith, such that in a bottle carrying position, the association of the aperture with the only one flap defines a diameter less than the diameter of the engaging edge of the bottle;

a plurality of access tabs formed in the center panel, wherein each aperture of the center panel has only one access tab associated therewith, and each access tab is disposed such that in the bottle carrying position the only one access tab is disposed opposite the only one flap; and a pair of handle panels connected to the pair of securing panels.

2. The blank of claim 1, wherein each access tab includes an arcuate portion on an end of the tab that extends into the associated aperture of the center panel.

3. The blank of claim 1, wherein:

each flap includes a curved lip and a hinge; and the flap is generally U-shaped.

4. The blank of claim 3, wherein:

the hinge of the flap is parallel to the pair of opposing edges of the center panel; and the hinge is disposed between one of the opposing edges of the center panel and the curved lip of the flap.

5. The blank of claim 3, wherein each aperture of the securing panel is defined by the curved lip of the flap, an access lip opposite the curved lip and a pair of main support lips disposed between the curved lip and the access lip.

6. The blank of claim 1, wherein:

each handle panel has a handle opening;

at least one of the handle openings has an edge; and the blank includes an exterior grip support panel connected to the edge of the at least one handle opening.

7. The blank of claim 1, wherein:

at least one of the handle panels has an outer edge; and the blank includes an interior grip support panel connected to the outer edge of the at least one handle panel.

8. A carrier for carrying a plurality of bottles, wherein each bottle has an engaging edge with a diameter, comprising:

a bottle carrying portion including a top panel connected to a bottom panel;

a plurality of apertures and a plurality of flaps formed in the top panel, wherein each aperture has only one flap associated therewith;

a plurality of apertures and a plurality of access tabs formed in the bottom panel, wherein each aperture of the bottom panel has only one access tab associated therewith, and the apertures and flaps of the top panel cooperate with the apertures and access tabs of the bottom panel to form a plurality of bottle receiving collars, such that each bottle receiving collar has the only one access tab disposed opposite the only one flap; and a handle attached to and extending from the bottle carrying portion.

9. The carrier of claim 8, wherein each access tab includes an arcuate portion on an end of the tab that extends into the associated aperture of the bottom panel.

10. The carrier of claim 8, wherein: each flap includes a curved lip and a hinge; and the flap is generally U-shaped.

11. The carrier of claim 10, wherein:

the carrier has a plurality of outer edges; and the hinge of each flap is parallel to at least one of the outer edges and is disposed between the at least one outer edge and the curved lip of the flap.

12. The carrier of claim 10, wherein each aperture of the top panel is defined by the curved lip of the flap, an access lip opposite the curved lip and a pair of main support lips disposed between the curved lip and the access lip.

13. The carrier of claim 8, wherein:

the handle includes a handle opening and an exterior grip support panel;

the handle opening has an edge; and the exterior grip support panel is connected to the edge of the handle opening.

14. The carrier of claim 8, wherein the handle includes a pair of handle panels.

15. The carrier of claim 14, wherein: at least one handle panel has an outer edge; and the at least one handle panel with the outer edge includes an interior grip support panel that is connected to the outer edge and is disposed between the pair of handle panels.

16. A method for forming a carrier for carrying a plurality of bottles, wherein each bottle has an engaging edge with a diameter, comprising:

creating a blank comprising a center panel having a plurality of apertures and a plurality of access tabs formed therein, wherein each center panel aperture has only one access tab therewith, a pair of opposing edges on the center panel, a pair of securing panels connected to the opposing edges of the center panel, a plurality of apertures and a plurality of flaps formed in the securing panels, wherein each aperture of the securing panel has only one flap associated therewith;

gathering the plurality of bottles having an engaging edge with a diameter;

placing the bottles into the apertures of the center panel;

pushing the center panel until the access tabs are temporarily displaced from an original position, allowing the center panel to proceed below the engaging edge of the bottle, at which point the temporarily displaced access tabs return back to the original position, now beneath the engaging edge;

placing the bottles into the apertures of the securing panels;

pushing the securing panels to displace the flaps, and continuing until the securing panels and the flaps are disposed beneath the engaging edges of the bottles, such that the only one access tab of each center panel aperture is disposed opposite the only one flap of each securing panel aperture, forming a bottle receiving collar; and adhering the securing panels to the center panel.

17. The method of claim 16, wherein:

the blank includes a pair of handle panels each having a handle opening formed therein;

a pair of fold lines are disposed between the center panel and the securing panels; and a pair of fold lines are disposed between the securing panels and the handle panels.

18. The method of claim 17, comprising:

folding the blank along the pair of fold lines between the center panel and the securing panels; and folding the blank along the pair of fold lines between the securing panels and the handle panels to form a carrying handle.

19. The method of claim 17, wherein:

at least one of the handle openings has an edge;

the blank includes an exterior grip support panel connected to the edge of the at least one handle opening, an interior grip support panel and a fold line disposed between the interior grip support panel and at least one of the handle panels; and the method comprises folding the blank along the fold line disposed between the interior grip support panel and the at least one handle panel and adhering the interior grip support panel to the at least one handle panel, so that the interior grip support panel is disposed between the pair of handle panels.

20. A blank for forming a carrier for carrying a plurality of bottles, wherein each bottle has an engaging edge with a diameter, comprising:

a center panel having formed therein a plurality of apertures and a plurality of access tabs, wherein each aperture of the center panel has only one access tab associated therewith, and each access tab includes an arcuate portion on an end of the tab that extends into the associated aperture;

a pair of opposing edges on the center panel;

a pair of securing panels connected to the opposing edges of the center panel; and a plurality of apertures and a plurality of flaps formed in the securing panels, wherein each aperture of the securing panel has only one flap associated therewith, such that the flaps and the access tabs are oriented in the same direction on the blank and in a bottle carrying position, the association of the aperture with the only one flap defines a diameter less than the diameter of the engaging edge of the bottle and the flaps are disposed such that when the securing panels are folded over the center panel, a plurality of bottle receiving collars are formed, with each collar having the only one access tab and the only one flap on opposite sides of the bottle receiving collar.

21. The blank of claim 20 wherein:

a pair of handle panels are connected to the pair of securing panels; and each handle panel has a handle opening formed therein.

22. A plurality of bottles and a carrier for carrying the plurality of bottles, comprising:

an engaging edge on each of the plurality of bottles;

a top panel having an upper surface, and further defining a plurality of apertures and a plurality of flaps, wherein each top panel aperture has a flap associated therewith; and a bottom panel connected to the top panel, and defining a plurality of apertures, each aperture having a bottle support lip, the bottom panel further defining a plurality of access tabs, wherein each bottom panel aperture has an access tab associated therewith;

wherein the apertures of the top and bottom panel cooperate with each other to form a plurality of bottle receiving collars; and wherein when the carrier is lifted each flap contacts the engaging edge of a corresponding bottle, the upper surface of the top panel contacts an opposite side of the engaging edge, and the bottle support lip assists the flap and the upper surface of the top panel in supporting the bottle engaging edge.

23. The carrier of claim 22, wherein each top panel aperture has only one flap associated therewith.

24. The carrier of claim 22, wherein each bottom panel aperture has only one access tab associated therewith.

25. The carrier of claim 22, wherein a handle is attached to and extends from the top panel.

* * * * *

UNITED STATES PATENT AND TRADEMARK OFFICE

CERTIFICATE OF CORRECTION

PATENT NO. : 5,682,982

DATED : November 4, 1997

INVENTOR(S) : Stonehouse

It is certified that error appears in the above-identified patent and that said Letters Patent is hereby corrected as shown below:

Column 2, line 65, delete "DESCRIPTUON" and replace with --DESCRIPTION--.

Column 3, line 22, delete the first occurrence of "Fig.".

Column 13, line 25, insert --12— after "Fig.".

Signed and Sealed this

Twenty-sixth Day of May, 1998

*Attest:*

Bruce Lehman

BRUCE LEHMAN

*Attesting Officer*

*Commissioner of Patents and Trademarks*